US008051750B2

(12) United States Patent
Zhou et al.

(10) Patent No.: US 8,051,750 B2
(45) Date of Patent: Nov. 8, 2011

(54) GUIDING DEVICE

(75) Inventors: Jiong Zhou, Shenzhen (CN); Gang Peng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 253 days.

(21) Appl. No.: 12/494,554

(22) Filed: Jun. 30, 2009

(65) Prior Publication Data

US 2010/0162855 A1 Jul. 1, 2010

(30) Foreign Application Priority Data

Dec. 29, 2008 (CN) ..... 2008 1 0306625

(51) Int. Cl.
*B25B 23/10* (2006.01)

(52) U.S. Cl. ..... 81/452; 81/57.37

(58) Field of Classification Search ..... 81/57.37, 81/300, 418, 433, 452, 454
See application file for complete search history.

(56) References Cited

U.S. PATENT DOCUMENTS

| | | | | |
|---|---|---|---|---|
| 2,842,997 | A * | 7/1958 | Wentling | 81/418 |
| 2,978,937 | A * | 4/1961 | Reynolds et al. | 81/57.37 |
| 3,200,863 | A * | 8/1965 | Feldpausch | 81/57.42 |
| 4,862,774 | A * | 9/1989 | Else et al. | 81/57.37 |
| 5,088,359 | A * | 2/1992 | Hockman | 81/57.37 |
| 5,671,642 | A * | 9/1997 | Haas | 81/57.37 |
| 6,314,845 | B1 * | 11/2001 | Wu | 81/455 |
| 2006/0266162 | A1 * | 11/2006 | Zurkirchen et al. | 81/57.37 |
| 2008/0276761 | A1 * | 11/2008 | Hale et al. | 81/57.37 |
| 2009/0031779 | A1 * | 2/2009 | Lefavour et al. | 72/416 |

* cited by examiner

*Primary Examiner* — David B Thomas
(74) *Attorney, Agent, or Firm* — Altis Law Group, Inc.

(57) ABSTRACT

A guiding device includes a connecting member, a first clamping arm, and a second clamping arm. The first clamping arm defines a first restricting groove and a first receiving groove in an end, and the first restricting groove communicates with the first receiving groove. The second clamping arm defining a second restricting groove and a second receiving groove in an end, and the second restricting groove communicates with the second receiving groove. The first clamping arm and the second clamping arm are rotatably connected to the connecting member. When the first clamping arm resists the second clamping arm, the first restricting groove and the second restricting groove cooperatively form a guiding portion. The first receiving groove and the second receiving groove cooperatively form a receiving portion. The receiving portion is substantially perpendicularly to the guiding portion to form a T-shaped groove.

11 Claims, 4 Drawing Sheets

GUIDING DEVICE

BACKGROUND

1. Technical Field

The present disclosure relates generally to guiding devices and, more particularly, to a guiding device for assembling screws.

2. Description of Related Art

In the manufacturing field, screws are used to connect two or more separate components. The screws are generally screwed into the components via a screw machine, in order to improve the assembling efficiency. The screw machine has a guiding device to ensure assembling the screws are assembled accurately.

A typical guiding device includes a guiding tube and an assembling tube. The guiding tube is obliquely connected and communicates with the assembling tube. A screw driver is partially received in the assembling tube. In use, the screws pass through the guiding tube, and enter in the assembling tube. The guiding tube is configured to guide the screw into the assembling tube, so that a screw cap of the screw can be opposite to the screw driver in the assembling tube. The screw driver drives the screws to engage in the components accurately.

However, when a length of the screws is equal to or less than a width of the screw caps, the screws may turn over in the guiding tube. Therefore, the screw cap may be not opposite to the screw driver in the assembling tube, and the screws may not face holes of the components, thus can not be engaged in the components driven by the screw driver.

Therefore, a guiding device which overcomes the above-described shortcomings is desired.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
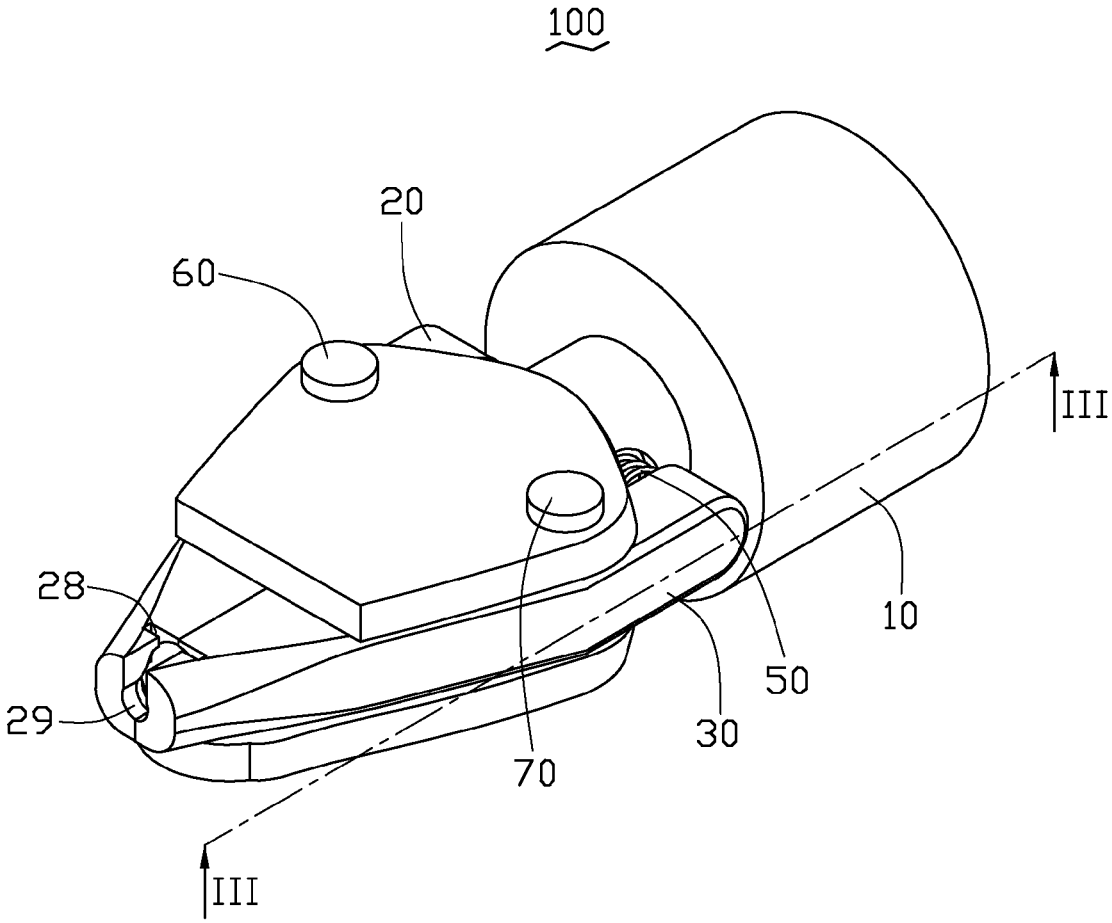
FIG. 1 is an isometric view of an embodiment of a guiding device.
Figure 4:
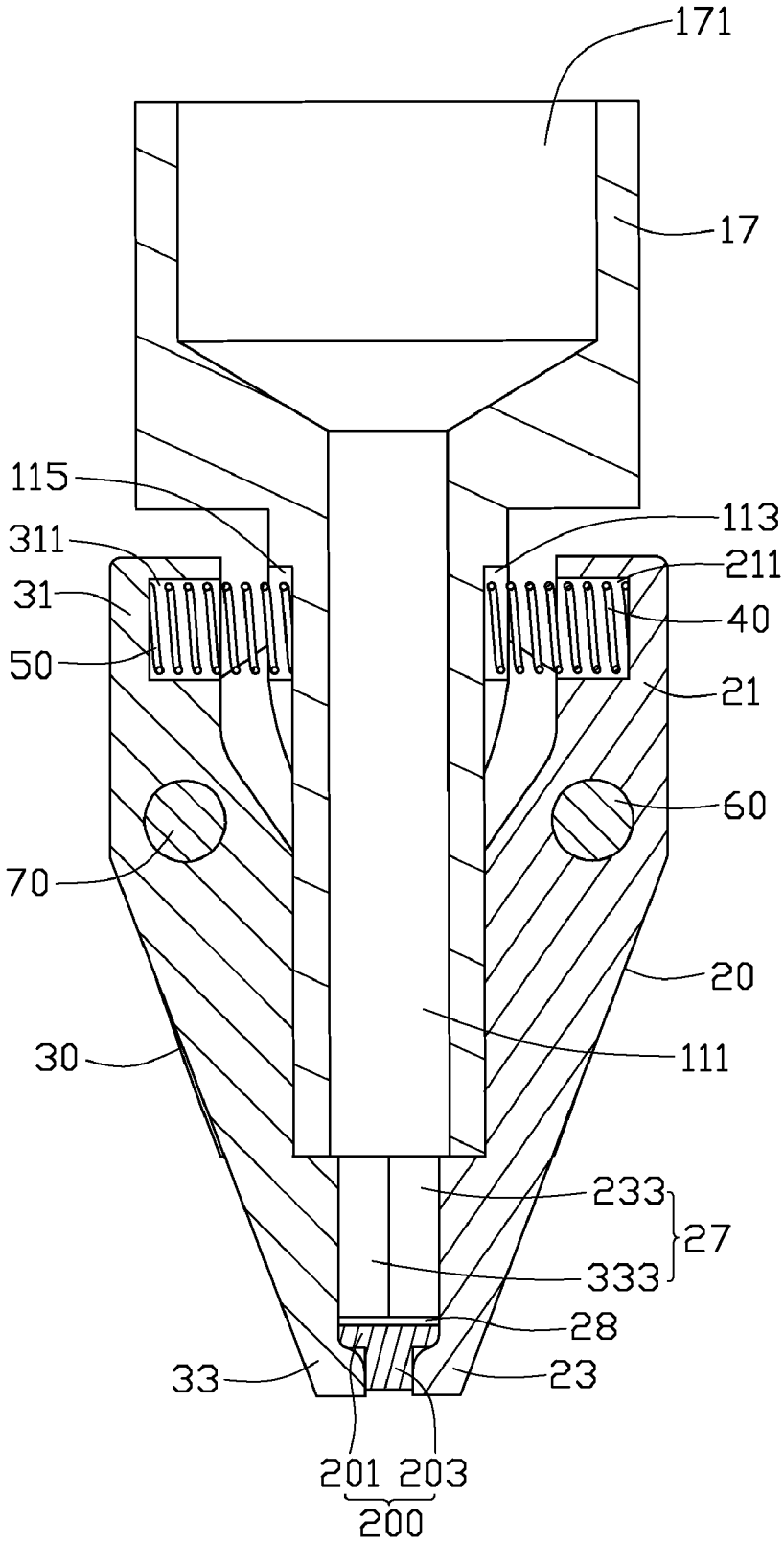
FIG. 4 is similar to FIG. 3, but the guiding device holding a screw.

Referring to FIGS. 1 and 4, an embodiment of a guiding device 100 includes a connecting member 10, a first clamping arm 20, a second clamping arm 30, a first elastic member 40, a second elastic member 50, a first pivot shaft 60, and a second pivot shaft 70. The guiding device 100 is used for guiding a screw 200 (shown in FIG. 4). The screw 200 includes a threaded portion 203 and a screw cap 201 formed on an end of the threaded portion 203.

Figure 2:
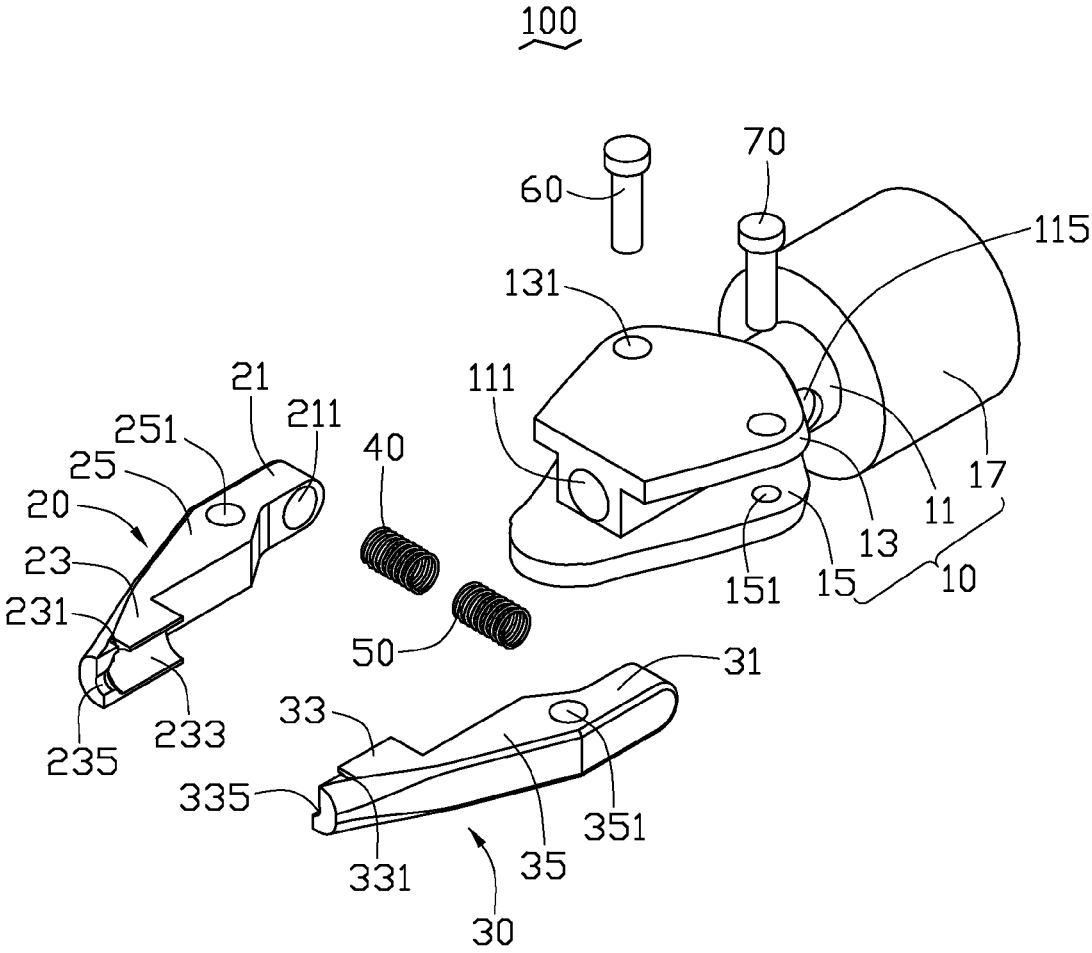
FIG. 2 is an exploded, isometric view of the guiding device of FIG. 1.
Figure 3:
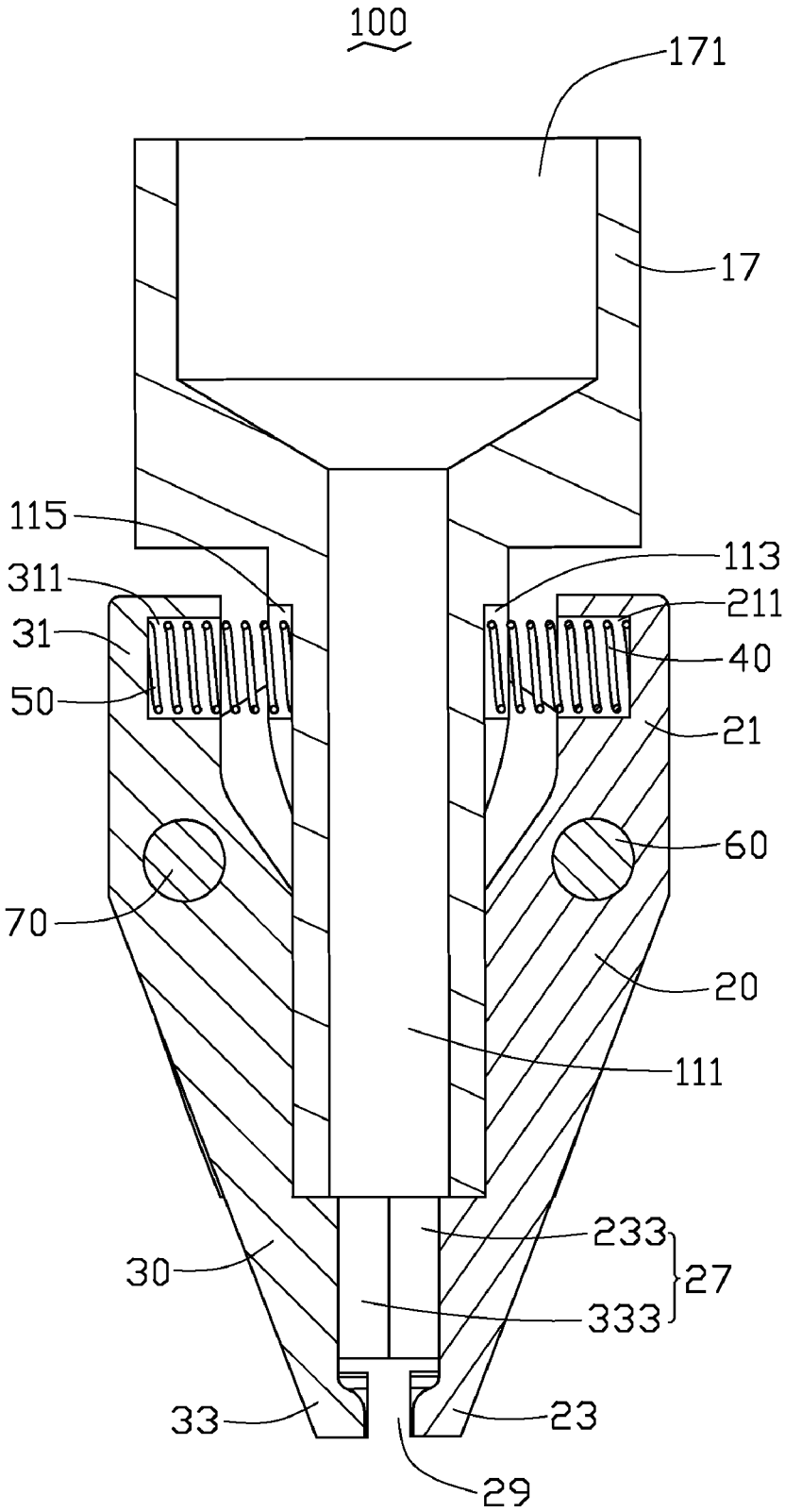
FIG. 3 is a side cross-sectional view of the guiding device of FIG. 1, taken along line III-III thereof.

Referring to FIGS. 1 through 3, the connecting member 10 includes a main body 11, a first positioning portion 13, a second positioning portion 15, and a connecting portion 17. The first positioning portion 13 and the second positioning portion 15 are formed on opposite sides of the main body 11, and substantially parallel to each other. The connecting portion 17 is formed on an end of the main body 11.

The main body 11 defines a first guiding hole 111 in a center, and a first receiving hole 113 and a second receiving hole 115 in opposite side surfaces. The first receiving hole 113 and the second receiving hole 115 extend along a same axis. An extending direction of the first guiding hole 111 is substantially perpendicular to an extending direction of the first receiving hole 113.

The first positioning portion 13 defines two first connecting holes 131 on opposite sides. The second positioning portion 15 defines two second connecting holes 151 on opposite sides corresponding to the first connecting holes 131. A size of the second positioning portion 15 is larger than that of the first positioning portion 13.

The connecting portion 17 is substantially cylindrical in this embodiment. The connecting portion 17 defines a connecting hole 171 communicating with the first guiding hole 111 of the main body 11.

The first clamping arm 20 includes a first main portion 25, a first fixing portion 21, and a first clamping portion 23. The first fixing portion 21 and the first clamping portion 23 are formed on opposite ends of the first main portion 25. The first main portion 25 defines a pivot hole 251. The first fixing portion 21 defines a first assembling hole 211 in a side surface. The first clamping portion 23 defines a first restricting groove 231, a first guiding groove 233, and a first receiving groove 235. The first guiding groove 233 and the first receiving groove 235 extend along a same direction.

The second clamping arm 30 includes a second main portion 35, a second fixing portion 31, and a second clamping portion 33. The second fixing portion 31 and the second clamping portion 33 are formed on opposite ends of the second main portion 35. The second main portion 35 defines a pivot hole 351. The second fixing portion 31 defines a second assembling hole 311 in a side surface. The second clamping portion 33 defines a second restricting groove 331, a second guiding groove 333, and a second receiving groove 335. The second guiding groove 333 and the second receiving groove 335 extend along a same direction.

In the illustrated embodiment, both the first elastic member 40 and the second elastic member 50 are compression springs.

In assembling the guiding device 100, the first pivot shaft 60 extends through one first connecting hole 131 of the first positioning portion 13, the pivot hole 251 of the first clamping arm 20, and engages in one second connecting hole 151 of the second positioning portion 15. The second pivot shaft 70 extends through another first connecting hole 131 of the first positioning portion 13, the pivot hole 351 of the second clamping arm 30, and engages in another second connecting hole 151 of the second positioning portion 15. Therefore, the first clamping arm 20 and the second clamping arm 30 are rotatably connected to the connecting member 10. The first elastic member 40 is compressed between the first clamping arm 20 and the connecting member 10. One end of the first elastic member 40 is received in the first assembling hole 211 of the first clamping arm 20, and the other end of the first elastic member 40 is received in the first receiving hole 113 of the connecting member 10. The second elastic member 50 is compressed between the second clamping arm 30 and the connecting member 10. One end of the second elastic member 50 is received in the second assembling hole 311 of the second clamping arm 30, and the other end of the second elastic member 50 is received in the second receiving hole 115 of the connecting member 10.

The first clamping portion 23 of the first clamping arm 20 resists the second clamping portion 33 of the second clamping arm 30 because of an elastic force produced by the first elastic member 40 and the second elastic member 50. In that case, the first guiding groove 233 and the second guiding groove 333 cooperatively form a second guiding hole 27 (see FIG. 3). The first restricting groove 231 and the second restricting groove 331 cooperatively form a guiding portion 28 (see FIG. 4). The first receiving groove 235 and the second receiving groove 335 cooperatively form a receiving portion 29. The guiding portion 28 is substantially perpendicular to the receiving portion 29, so that the screw 200 can be received in the guiding portion 28 and the receiving portion 29.

In use, referring to FIG. 4, the screw 200 is positioned in the guiding device 100 with the threaded portion 203 engaged in the receiving portion 29 and the screw cap 201 engaged in the guiding portion 28. A screw driver (not shown) extends through the first guiding hole 111 and the second guiding hole 27, and contacts the screw cap 201. The screw driver drives the screw 200 to move in a direction away from the connecting portion 17, urging the screw 200 to resist the first clamping portion 23 of the first clamping arm 20 and the second clamping portion 33 of the second clamping arm 30. The first clamping arm 20 rotates around the first pivot shaft 60, and the second clamping arm 30 rotates around the second pivot shaft 70, thereby compressing the first elastic member 40 and the second elastic member 50. The screw 200 is driven to rotate and move forwards by the screw driver, until the screw 200 is fastened into a workpiece (not shown). Once the screw 200 is engaged into the workpiece, the screw driver moves backwards, and the first clamping arm 20 and the second clamping arm 30 are brought back to each other again driven by an elastic restoring force of the first elastic member 40 and the second elastic member 50.

The guiding device 100 defines the guiding portion 28 and the receiving portion 29 communicating with the guiding portion 28. That is, a T-shaped groove corresponding to the screw 200 is cooperatively formed by the guiding portion 28 and the receiving portion 29. Therefore, the screw 200 can be firmly held by the guiding device 100 before being fastened into the workpiece. That is, the screw 200 cannot turn over in the guiding device 100.

It should be pointed out that one of the first clamping arm 20 and the second clamping arm 30 may be fixed to the connecting member 10, and the other one of the first clamping arm 20 and the second clamping arm 30 is rotatably connected to the connecting member 10. In addition, a connecting interface between the guiding portion 28 and the receiving portion 29 can be curved surfaces, so that the screw 200 can easily be pushed into the T-shaped groove formed by the guiding portion 28 and the receiving portion 29.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A guiding device, comprising:

a connecting member;

a first clamping arm defining a first restricting groove and a first receiving groove in an end, the first restricting groove communicating with the first receiving groove;

a second clamping arm defining a second restricting groove and a second receiving groove in an end, the second restricting groove communicating with the second receiving groove; and a first elastic member and a second elastic member; the first elastic member positioned between the first clamping arm and the connecting member, and the second elastic member positioned between the second clamping arm and the connecting member;

wherein both of the first clamping arm and the second clamping arm are rotatably connected to the connecting member; when the first clamping arm resists the second clamping arm, the first restricting groove and the second restricting groove cooperatively form a guiding portion, and the first receiving groove and the second receiving groove cooperatively form a receiving portion; the receiving portion is substantially perpendicularly to the guiding portion to form a T-shaped groove.

2. The guiding device of claim 1, wherein each of the first elastic member and the second elastic member is a compression spring.

3. The guiding device of claim 1, wherein the connecting member comprises a main body; the main body defines a first guiding hole.

4. The guiding device of claim 3, wherein the first clamping arm further defines a first guiding groove communicating with the first restricting groove, the second clamping arm further defines a second guiding groove communicating with the second restricting groove; when the first clamping arm resists the second clamping arm, the first guiding groove communicates with the second guiding groove to form a second guiding hole.

5. The guiding device of claim 3, wherein the first clamping arm comprises a first main portion, a first fixing portion, and a first clamping portion; the first fixing portion and the first clamping portion are formed on opposite ends of the first main portion.

6. The guiding device of claim 5, wherein the second clamping arm comprises a second main portion, a second fixing portion, and a second clamping portion; the second fixing portion and the second clamping portion are formed on opposite ends of the second main portion.

7. The guiding device of claim 6, wherein the main body defines a first receiving hole and a second receiving hole in opposite side surface; an end of the first elastic member is received in the first receiving hole, and an end of the second elastic member is received in the second receiving hole.

8. The guiding device of claim 7, wherein the first fixing portion defines a first receiving hole, the other end of the first elastic member is received in the first receiving hole; the second fixing portion defines a second receiving hole, the other end of the second elastic member is received in the second receiving hole.

9. The guiding device of claim 3, wherein the connecting member further comprises a first positioning portion and a second positioning portion formed on opposite sides of the main body; the first clamping arm and the second clamping arm are positioned between the first positioning portion and the second positioning portion.

10. The guiding device of claim 1, further comprising a first pivot shaft, the first clamping arm is rotatably connected to the connecting member via the first pivot shaft.

11. The guiding device of claim 10, further comprising a second pivot shaft, the second clamping arm is rotatably connected to the connecting member via the second pivot shaft.

* * * * *